US008075102B2

(12) United States Patent
Hatsui et al.

(10) Patent No.: US 8,075,102 B2
(45) Date of Patent: Dec. 13, 2011

(54) SUBSTRATE FOR INK JET HEAD AND INK JET HEAD

(75) Inventors: Takuya Hatsui, Tokyo (JP); Hirokazu Komuro, Yokohama (JP); Kazuaki Shibata, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 403 days.

(21) Appl. No.: 12/483,789

(22) Filed: Jun. 12, 2009

(65) Prior Publication Data

US 2009/0315952 A1 Dec. 24, 2009

(30) Foreign Application Priority Data

Jun. 19, 2008 (JP) ..... 2008-160676

(51) Int. Cl.
*B41J 2/05* (2006.01)

(52) U.S. Cl. ..... 347/58; 347/57; 347/62

(58) Field of Classification Search ..... 347/20, 347/49, 50, 56–69
See application file for complete search history.

(56) References Cited

U.S. PATENT DOCUMENTS

| | | | | |
|---|---|---|---|---|
| 6,409,315 | B2 | 6/2002 | Komuro | |
| 6,799,822 | B2 * | 10/2004 | Cleland et al. | 347/58 |
| 6,962,405 | B2 | 11/2005 | Imanaka et al. | |
| 7,374,275 | B2 | 5/2008 | Shibata et al. | |
| 7,441,877 | B2 | 10/2008 | Kubo et al. | |
| 7,566,116 | B2 | 7/2009 | Saito et al. | |
| 2006/0033779 | A1 | 2/2006 | Shibata et al. | |
| 2006/0232633 | A1 | 10/2006 | Kubo et al. | |
| 2007/0252873 | A1 | 11/2007 | Saito et al. | |
| 2008/0188018 | A1 | 8/2008 | Shibata et al. | |
| 2008/0273053 | A1 | 11/2008 | Takeuchi et al. | |

FOREIGN PATENT DOCUMENTS

| | | | |
|---|---|---|---|
| EP | 0118640 | A2 | 9/1984 |
| JP | 59-095154 | A | 6/1984 |
| JP | 62-013367 | A | 1/1987 |
| JP | 06-316075 | A | 11/1994 |
| JP | 10-044416 | A | 2/1998 |

* cited by examiner

*Primary Examiner* — Juanita D Stephens
(74) *Attorney, Agent, or Firm* — Fitzpatrick, Cella, Harper & Scinto

(57) ABSTRACT

A substrate for an ink jet head is provided with a plurality of energy generating members generating energy used for discharging an ink, an electrode pad which is arranged near a side of the substrate, and is for electrically connecting to an outside of the substrate, a plurality of electrode wirings for electrically connecting the plurality of energy generating members and the electrode pad, and a plurality of resistance elements which are respectively provided at the plurality of electrode wirings. Resistance values of the plurality of resistance elements differ from one another according to resistance values of the electrode wirings provided with the respective resistance elements.

6 Claims, 5 Drawing Sheets

SUBSTRATE FOR INK JET HEAD AND INK JET HEAD

BACKGROUND OF THE INVENTION

1. Field of the Invention

The present invention relates to a substrate for an ink jet head (hereinafter, also simply called as "substrate") provided with energy generating members generating energy used for discharging an ink, and an ink jet head including the substrate.

2. Description of the Related Art

Japanese Patent Application Laid-Open No. S59-095154 discloses an ink jet recording apparatus of a method of vertically discharging an ink to a substrate from an ink supply port.

A substrate loaded on an ink jet recording apparatus of this kind has an ink supply port forming a rectangular opening so as to penetrate through a center of the substrate. The substrate supplies an ink or multicolor inks with high density to a discharge port from an ink supply port. A heat generating resistance element is arranged along the long side of the ink supply port, and is connected with an electrode pad with wirings to receive supply of a current from the electrode pad.

The electrode pad is provided perpendicularly to the side of a substrate outer periphery which is horizontal with the short side of the ink supply port, and at this position, the electrode pad is connected with an external wiring board. When the electrode pad is provided along the side of the outer periphery of the substrate to be parallel with the short side of the ink supply port, the length of electrode wiring until the electrode wiring reaches heat generating resistance elements from the electrode pad becomes long. The length of the electrode wiring and the resistance of the electrode wiring are proportional to each other. Therefore, when the length of the electrode wiring becomes long, the resistance of the electrode wiring becomes large. In this case, if a plurality of heat generating resistance elements connected to the same electrode wiring is driven at the same time, the voltage drop difference in the wiring portions significantly differs depending on the number of the heat generating resistance elements which are driven at the same time. Thus, it becomes difficult to obtain proper foaming, and high-quality recording becomes difficult.

Here, the ink jet recording head described in Japanese Patent Application Laid-Open No. H10-044416 deals a plurality of heat generating resistance elements disposed on the substrate as one block, and has a plurality of blocks. Only one heat generating resistance element out of each of the blocks is driven at the same time. This is called block time-sharing drive. According to this, the difference in voltage drop in the wiring portions connected to the heat generating resistance elements can be made constant, and therefore, proper foaming can be obtained.

However, there is the problem that when the width of the electrode wiring on the substrate becomes large, the size of the substrate also increases.

Japanese Patent Application Laid-Open No. S62-13367 discloses a thermal head which can suppress unevenness of density by making the heat generation temperatures of respective heat generating resistance elements substantially constant. An individual electrode is connected to one end of a heat generating resistance element. A common electrode is connected to the other end of the heat generating resistance element. The respective heat generating resistance elements are arranged to be parallel at predetermined intervals. These heat generating resistance elements are divided into eight blocks, and an L-shaped slit for restricting the flow of a current is provided between the blocks. A resistance member for fine-adjusting a voltage is disposed in each of current passages of the common electrode divided by the L-shaped slits (FIGS. 4A and 4B in Japanese Patent Application Laid-Open No. S62-013367).

However, in this case, in order to place the resistance members at the positions illustrated in FIGS. 4A and 4B, the width of the electrode wiring on the substrate also needs to be larger than a certain extent, and there is the problem of increasing the size of the substrate.

SUMMARY OF THE INVENTION

An object of the present invention is to provide a substrate for an ink jet head which can achieve high-quality recording and prevent increase in size, and an ink jet head including the subject.

In order to attain the above described object, a substrate for an ink jet head of the present invention is a substrate for an ink jet head provided with a plurality of energy generating members generating energy used for discharging an ink, wherein the plurality of energy generating members are provided in a row in a longitudinal direction of the substrate, the substrate has an electrode pad which is arranged near a side of the substrate extending in an intersecting direction intersecting with respect to the longitudinal direction, and is for electrically connecting to an outside of the substrate, a plurality of electrode wirings for electrically connecting the plurality of energy generating members and the electrode pad, and a plurality of resistance elements which are respectively provided at the plurality of electrode wirings, each of the plurality of electrode wirings includes a first portion extending in the longitudinal direction from a side of the electrode pad of each of the electrode wirings, and a second portion which extends in the intersecting direction from a side of the first portion opposite from the side of the electrode pad toward the energy generating members and is provided with the resistance elements and resistance values of the plurality of resistance elements differ from one another according to resistance values of the electrode wirings provided with the respective resistance elements.

According to the present invention, the potential differences between the energy generating members and the electrode pads can be made equivalent to each other by the resistance elements for adjustment. Therefore, discharge of the ink from each of discharge ports becomes stable to be able to achieve recording with high quality. The electrode wiring extending in the longitudinal direction of the substrate can be disposed with the minimum width, and therefore, increase in the size (width) of the substrate for an ink jet head can be prevented.

Further features of the present invention will become apparent from the following description of exemplary embodiments with reference to the attached drawings.

DESCRIPTION OF THE EMBODIMENTS

Figure 1:
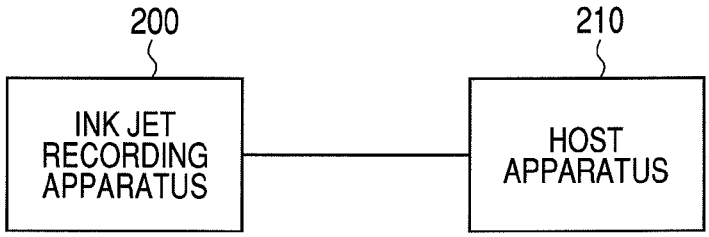
FIG. 1 is a block diagram illustrating a configuration of an ink jet recording system in the present embodiment.

A mode for carrying out the present invention will be described in detail with reference to the drawings. First, a configuration example of an ink jet recording apparatus to which the present invention is applicable will be described. FIG. 1 is a block diagram illustrating a configuration of an ink jet recording system in the present embodiment. An ink jet recording system of the present embodiment has a host apparatus 210 such as a host computer and an ink jet recording apparatus 200.

The host apparatus 210 is connected to the ink jet recording apparatus 200, and transmits a record data signal indicating record data such as an image to the ink jet recording apparatus 200. Connection of the host apparatus 210 and the ink jet recording apparatus 200 may be through a cable 220 such as a USB (Universal Serial Bus) cable. Alternatively, connection of the host apparatus 210 and the ink jet recording apparatus 200 may be by radio such as Bluetooth (registered trademark) or infrared rays.

When receiving a record data signal from the host apparatus 210, the ink jet recording apparatus 200 performs processing for discharging liquid droplets of an ink, such as generation of thermal energy, and records the record data on a recording sheet 307.

Figure 3A:
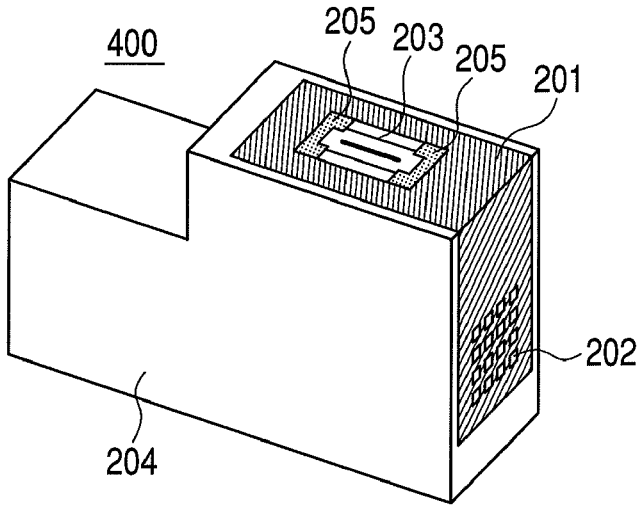
FIG. 3A is a perspective view illustrating an ink jet recording head in the present embodiment.
Figure 3B:
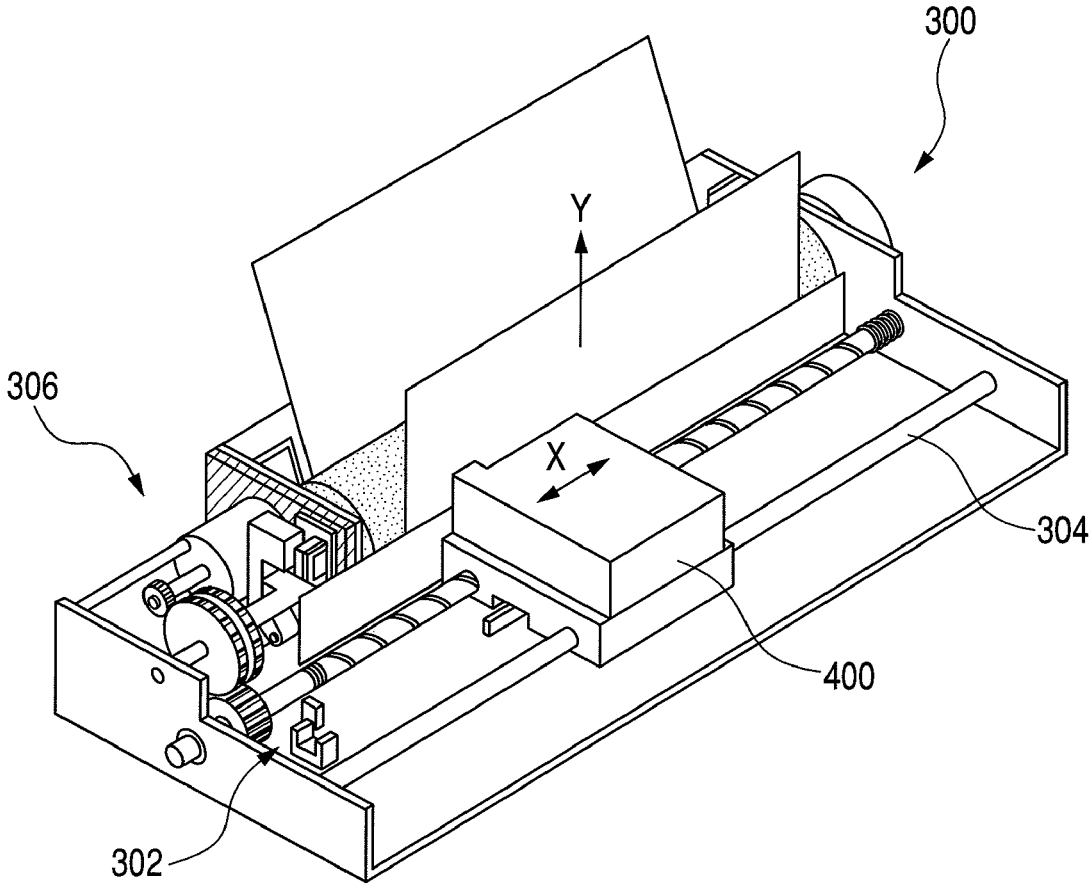
FIG. 3B is a perspective view illustrating the ink jet recording apparatus in the present embodiment.

FIG. 3B is a perspective view of the ink jet recording apparatus 300 in the present embodiment. The ink jet recording apparatus 300 has a head moving mechanism 302, a carriage 303, a guide shaft 304, a sheet conveying mechanism 306 and a recording head 400.

The ink jet recording apparatus 300 is a serial scan type recording apparatus as one example of a printing method. The ink jet recording apparatus 300 records record data on the recording sheet by reciprocating the recording head 400 in the main scanning direction shown by the arrow X.

The ink jet recording apparatus 300 is further loaded with the recording head 400, which is freely attachable and detachable, on the carriage 303. The carriage 303 is supported by the guide shaft 304, and moves in the main scanning direction on the guide shaft 304 together with the recording head 400 by drive of the head moving mechanism 302.

The sheet conveying mechanism 306 is disposed at a position opposed to the recording head 400 which is supported on the carriage 303. The sheet conveying mechanism 306 has a platen roller 305, and by drive of the platen roller 305, the recording sheet 307 is sequentially conveyed in an auxiliary scanning direction shown by the arrow Y.

FIG. 3A is a perspective view illustrating the ink jet recording head in the present embodiment. A TAB tape 201 is joined to a wall surface of an ink tank 204, and its inner lead portion is sealed with a sealant 205. Further, the TAB tape 201 is folded along the wall surface of the ink tank 204, and a portion provided with a contact pad 202 is bonded and fixed to the wall surface of the ink tank 204. FIG. 3A illustrates a state in which the substrate 203 is faced upward, but when the recording head is mounted to the ink jet recording apparatus, the substrate 203 is in the posture faced downward.

Figure 2:
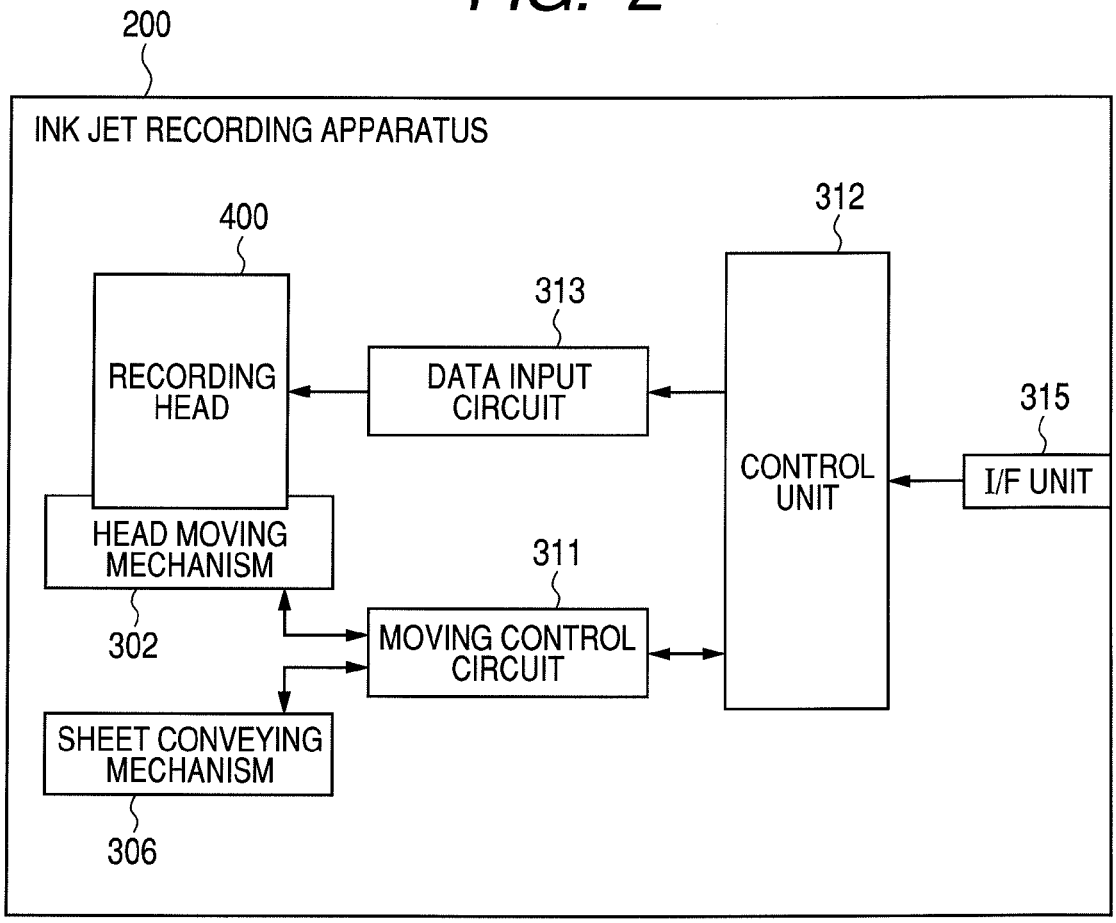
FIG. 2 is a block diagram illustrating an ink jet recording apparatus in the present embodiment.

FIG. 2 is a block diagram illustrating a configuration of the ink jet recording apparatus in the present embodiment. The ink jet recording apparatus 200 has a head moving mechanism 302, a sheet conveying mechanism 306, a moving control circuit 311, a control unit 312, a data input circuit 313 and a recording head 400.

The moving control circuit 311 is connected to the sheet conveying mechanism 306, and is also connected to the recording head 400 via the head moving mechanism 302. The recording head 400 is connected to the data input circuit 313, and is also connected to the moving control circuit 311 via the head moving mechanism 302. The control unit 312 is connected to the moving control circuit 311 and the data input circuit 313. Further, the control unit 312 is connected to the host apparatus 210 via the cable 220 connected to a communication I/F (Interface) 315.

When receiving a record data signal from the host apparatus 210 (not illustrated), the control unit 312 outputs a record data signal to the data input circuit 313, and starts control of the head moving mechanism 302 and the sheet conveying mechanism 306 to synchronize the head moving mechanism 302 and the sheet conveying mechanism 306. The data input circuit 313 outputs the record data signal from the control unit 312 to the recording head 400 in synchronism with the head moving mechanism 302 and the sheet conveying mechanism 306, and record data is recorded by the recording head 400.

The recording head 400 holds an ink which is always supplied from an ink tank (not illustrated). The recording head 400 is provided with a recording logic circuit (not illustrated). When receiving the record data from the data input circuit 313, the recording logic circuit drives a plurality of energy generating members which generate energy used for discharging the ink. In the present embodiment, a number of heat generating resistance elements (not illustrated) which will be described later are selected as the energy generating members, and the heat generating resistance elements (not illustrated) are caused to generate heat. By heat generated by the selected heat generating resistance elements, the held ink is foamed, and liquid droplets of the ink are discharged from discharge ports corresponding to the selected heat generating resistance elements. As a result that the liquid droplets adhere to the surface of the recording sheet 307 (not illustrated), an image of a dot matrix is formed.

Figure 4A:
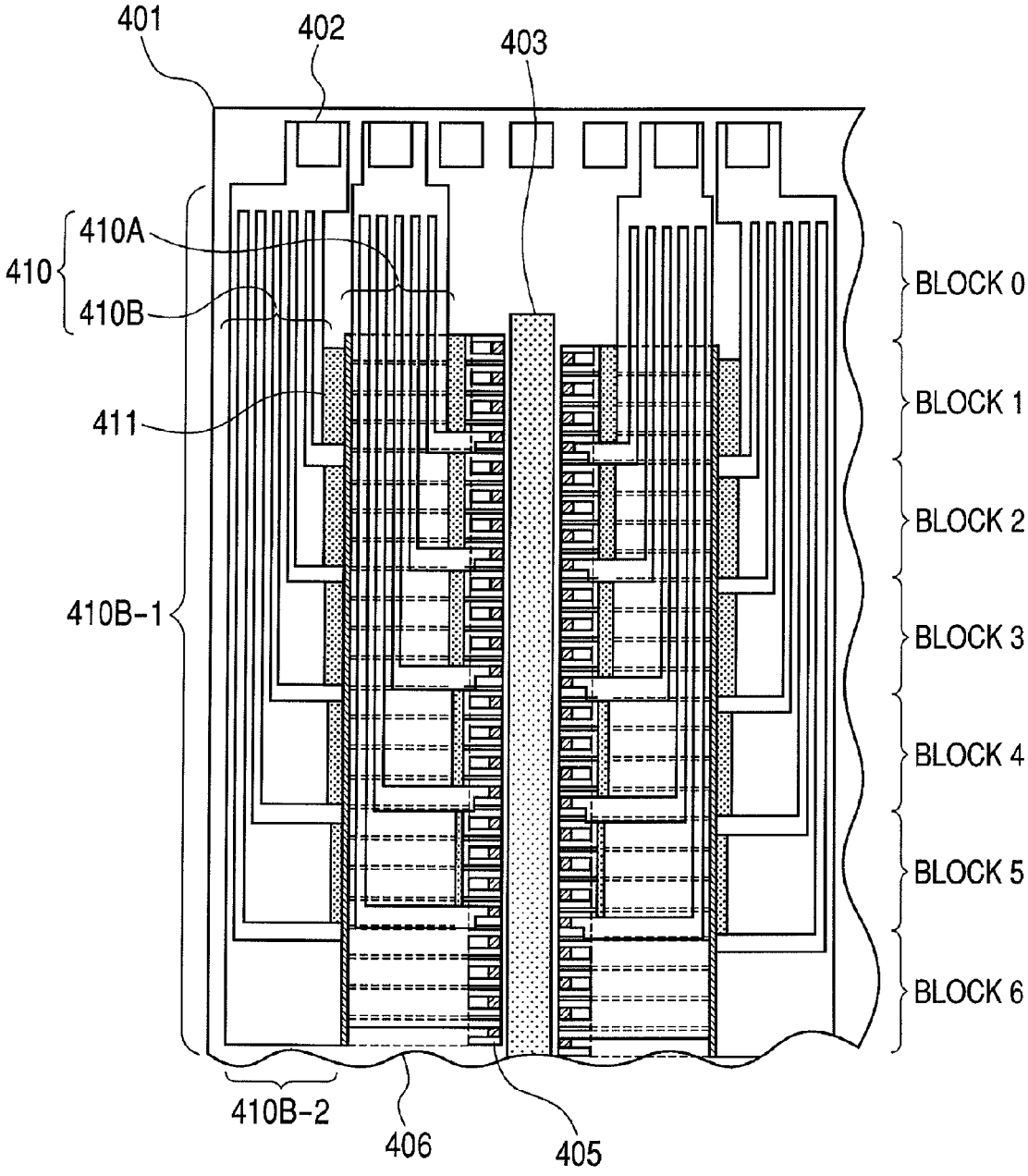
FIG. 4A is a top view of a substrate for an ink jet head in the present embodiment.
Figure 4B:
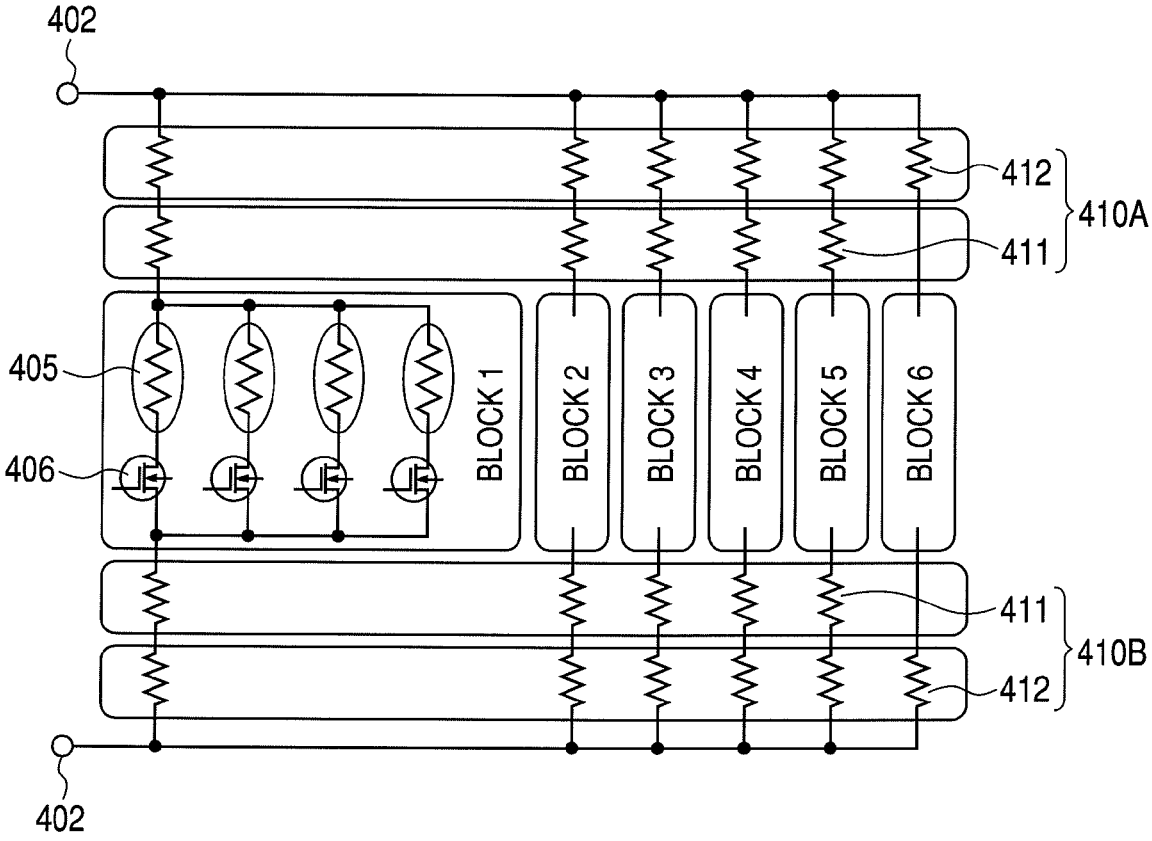
FIG. 4B is a circuit diagram of the substrate for the ink jet head in the present embodiment.

The recording head 400 of the present embodiment has an ink jet recording substrate 401 and a member provided with a discharge port for an ink. FIG. 4A is a top view of the substrate 401 for an ink jet head in the present embodiment. FIG. 4B is a circuit diagram of the substrate for an ink jet head in the present embodiment.

The substrate 401 has an electrode pad 402, an ink supply port 403, a heat generating resistance element 405, a driving element 406, electrode wirings 410A and 410B, and a resistance element for adjusting a voltage (hereinafter, also called "adjustment resistance element") 411.

A plurality of ink channels for discharging an ink, and discharge ports (not illustrated) communicating with the ink channels are formed on a top layer of the substrate 401 by a photolithography technique. Further, an ink supply section (not illustrated) for supplying an ink to the ink supply port 403 from the ink tank is connected to a lower portion of the substrate 401.

A Si (Silicon) substrate is used for the substrate 401. The substrate is provided with at least one ink supply port 403. The ink supply port 403 penetrates through the substrate to supply the ink to the ink channels from the ink supply section.

A plurality of heat generating resistance elements 405 are arranged in a row at each of both sides of the ink supply port 403 in such a manner as to extend in a longitudinal direction of the substrate along a long side of the ink supply port 403, on a top surface of the substrate 401. Further, driving elements 406 are arranged on an outer side than the heat generating resistance elements 405.

The electrode pads 402 are arranged closely along a side (side extending in an intersecting direction to intersect with respect to the longitudinal direction of the substrate) of an outer periphery of the substrate parallel with a short side of the ink supply port 403, and are electrically connected to an external wiring board (not illustrated). In the present embodiment, the longitudinal direction of the substrate and the intersecting direction intersecting the longitudinal direction of the substrate form a right angle. A bump (not illustrated) on the electrode pad 402 and an electrode lead (not illustrated) of an electric wiring tape are electrically joined by a thermo-compression bonding method.

The heat generating resistance element 405 has one end connected to the electrode wiring 410A, and the other end connected to the driving element 406. The other end of the driving element 406 is connected to the electrode wiring 410B. More specifically, the driving element 406 for driving the heat generating resistance element 405 is provided between the electrode wiring 410B and the heat generating resistance element 405. The electrode wiring 410B electrically connects a plurality of heat generating resistance elements 405 and the electrode pad 402 with the driving elements 406 interposed therebetween. In the present application, "electrically connect" is used as the expression including connection having the interposed element like this. The electrode wiring 410 is divided into each of the electrode wiring A 410A and the electrode wiring B 410B in the vicinity of the electrode pads 402, and the electrode wiring A 410A and the electrode wiring B 410B are connected to different electrode pads 402. A pair of electrode wirings 410 is placed with the ink supply port therebetween. There are also the electrode wirings (not illustrated) connected to the electrode pads (not illustrated) arranged on the side of the outer periphery of the substrate at an opposite side. Therefore, the present embodiment has four pairs of electrode wirings 410 (four electrode wirings 410A and four electrode wirings 410B) for one ink supply port.

The electrode pad 402 is used for sending an electric signal to a recording logic circuit (not illustrated) from the data input circuit 313, in addition to the above. The recording logic circuit moves the selected driving element 406 with the signal, and passes the current to the heat generating resistance element 405 through the electrode wiring 410.

The ink supplied from the ink supply port 403 is filled into the discharge ports from the ink channels. By passing a current, the heat generating resistance element 405 is caused to generate heat, and the thermal energy generated by heat generation is transferred to the ink in the ink channels to generate bubbles in the ink. By generation of the bubbles, the liquid droplets of the ink are discharged from the discharge ports.

A part relating to the electrode wiring 410 will be described in detail hereinafter.

The heat generating resistance elements 405 are divided into a plurality of blocks (from block 1 to block 6, as an example). By control of drive of the driving element 406 by the recording logic circuit, the respective heat generating resistance elements 405 in the same block are not driven at the same time. The present embodiment shows an example in which four of the heat generating resistance elements 405 are disposed on the substrate in the block for convenience, but 16 or more of the heat generating resistance elements 405 are generally disposed on the substrate.

A first portion 410A-1 (not illustrated) of the electrode wiring 410A extends to an upper portion of the driving element 406 outside the heat generating resistance element 405 parallel with the row of the heat generating resistance elements 405 from the electrode pad 402 for the electrode wiring A. A second portion 410A-2 (not illustrated) of the electrode wiring 410A is formed continuously from the first portion 410A-1, extends toward the ink supply port 403 from the upper portion of the driving element 406 perpendicularly to the row of the heat generating resistance elements, and connects to one end of the heat generating resistance element 405. The other end of the heat generating resistance element 405 is connected to a second portion 410B-2 of the electrode wiring 410B via the driving element 406. A first portion 410B-1 of the electrode wiring 410B is formed continuously from the other end of the second portion 410B-2, and is connected to the electrode pad 402 for the electrode wiring 410B to be along the ink supply port 403.

The lengths of the electrode wirings differ for each block, and therefore, the resistance value of the electrode wiring 410 varies in each of the blocks. If printing is performed without adjusting the resistance value, the voltage applied to the heat generating resistance element 405 varies in each of the blocks, and proper thermal energy cannot be generated. If the thermal energy is too low, the liquid droplets of the ink are not formed, and the ink is not discharged. Meanwhile, if the thermal energy is too high, the size of the liquid droplet of the ink changes, and the heat generating resistance element 405 breaks at the early stage. Therefore, it is preferable the widths of the electrode wirings differ from each other so that the respective wiring resistance values in the respective blocks correspond to one another.

When the size of the substrate 401 is increased with the increased number of the heat generating resistance elements in order to achieve a longer printing width, the number of electrode wirings having the width larger than the electrode wiring having the largest width increases. Even the electrode wiring having the large width only can connect the same number of heat generating resistance elements 405 (four in the drawing) as the other electrode wirings. Accordingly, if the length of the printing width is to be extended, the width of the substrate abruptly increases, and it becomes difficult to load the substrate on the recording head.

According to the present embodiment, the first portions 410A-1 and 410B-1 of the electrode wiring 410 have the same widths, and prevent increase in width of the substrate. In this case, in the first portions 410A-1 and 410B-1 of the electrode wiring 410 which are branched, the resistance values of the wiring resistors 412 differ in the respective blocks, and in this state, proper thermal energy cannot be generated at the same time. Thus, in the present embodiment, by newly providing the adjustment resistance element 411 on the substrate 401, the resistance values of the different wiring resistors 412 are adjusted to be the same. In the present embodiment, among the electrode wirings connected to the same electrode pad, the electrode wiring connected to the farthest block from the electrode pad is not provided with the adjustment resistance element. Further, the resistance value of the adjustment resistance element of the electrode wiring which is connected to the block which is the closest to the electrode pad is set as the largest. Specifically, among a plurality of heat generating resistance elements 405, the heat generating resistance element 405 at a shorter distance from the electrode pad 402 has a larger resistance value of the adjustment resistance element 411 which is provided correspondingly. The adjustment resistance element 411 is provided at a position near to the heat generating resistance element 405 (near to the right side in FIG. 4A) in the second portion 410B-2 of the electrode wiring in the embodiment of FIGS. 4A and 4B. However, the position is not limited to this, and the adjustment resistance element 411 may be provided at another position in the second portion 410B-2 of the electrode wiring.

As the adjustment resistance element 411, use of a resistance element of polysilicon of a layer different from that of the electrode wiring 410 is conceivable. However, a through-hole for passing through an insulating layer between wiring layers is required. Further, the wiring layers of the other elements such as the driving element and the selecting circuit which are stacked under the electrode wiring have to be avoided. Further, when a diffusion layer resistance using a diffusion layer formed by diffusing a conductive impurity in the substrate is used, a space for disposing the diffusion resistance needs to be ensured in the substrate.

In the present embodiment, in the substrate 401, another portion of the resistance layer including the portion forming the heat generating resistance elements 405 is used as the adjustment resistance element 411. According to this, the resistance layer forming the heat generating resistance element 405 and the electrode wiring are formed as the continuous layer without having an insulating layer therebetween. Therefore, when the heat generating resistance element 405 is formed, a through-hole between the wiring layers is not required. Further, the other wiring layers are not influenced.

FIGS. 5A to 5F are views illustrating the procedure of manufacturing the substrate for an ink jet head in the present embodiment.

Figure 5A:
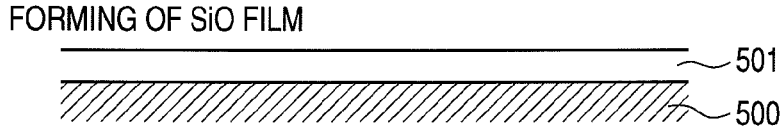
FIGS. 5A, 5B, 5C, 5D, 5E and 5F are views illustrating the procedure of manufacturing the substrate for an ink jet head in the present embodiment.
Figure 5B:
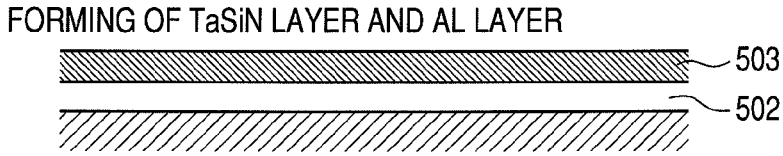
Figure 5C:
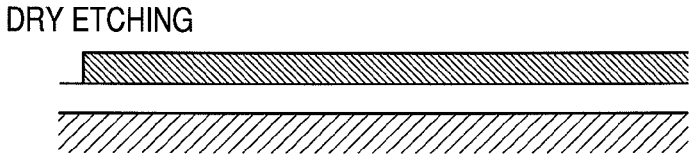
Figure 5D:
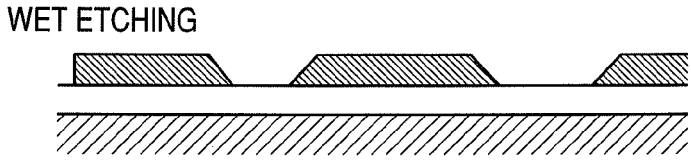

First, a driving element and a selecting circuit (both are not illustrated) are formed on an Si substrate 500. Subsequently, by using a plasma CVD (Chemical Vapor Deposition) method, an SiO film 501 to be an inter-layer insulating film from the electrode wiring is formed (FIG. 5A). After a through-hole is provided, a TaSiN layer 502 to be the material of the heat generating resistance element 405 is formed to a thickness of about 500 angstroms by a sputtering method. Thereafter, an AL layer 503 to be the electrode wiring layer is formed to a thickness of about 3500 angstroms (FIG. 5B). The TaSiN layer and the AL layer are patterned into a predetermined shape by a photolithography method. By dry etching using BC13 gas, the AL layer and the TaSiN layer are formed into the patterned shape at the same time (FIG. 5C). The portion where the heat generating resistance element 405 is disposed and the portion where the adjustment resistor of the electrode wiring 410 is disposed are patterned into predetermined shapes by a photolithography method. By wet etching with phosphoric acid as a main component, the portion where the heat generating resistance element 405 is disposed and the portion where the adjustment resistor of the electrode wiring 410 is disposed are formed into the patterned shapes (FIG. 5D).

Figure 5E:
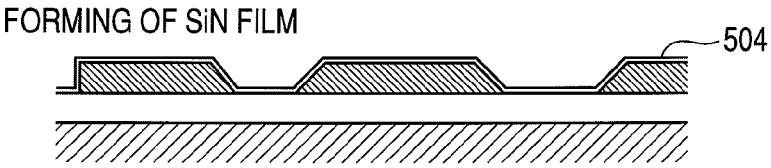
Figure 5F:
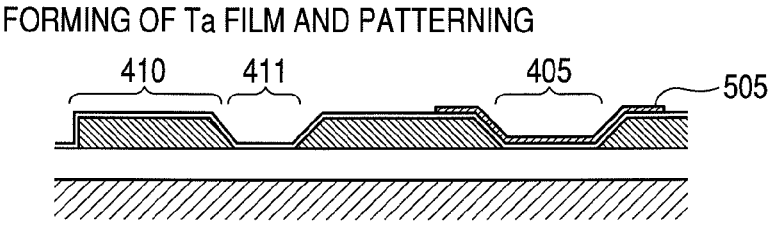

Further, by a plasma CVD method, an SiN film 504 to be a protection film is formed to a thickness of about 3000 angstroms (FIG. 5E). By a sputtering method, a Ta film to be a cavitation resistant film is formed to a thickness of about 2000 angstroms. By a photolithography method, a Ta film 505 and an SiN film are dry-etched to be into the predetermined shapes (FIG. 5F). Finally, by using a photolithography method, the ink channel is formed into a three-dimensional shape by an organic resin layer. The substrate 401 is manufactured according to such a procedure.

According to this, the adjustment resistance elements 411 which adjust the resistance values of the wiring resistors 412 of the first portions 410A-1 and 410B-1 of the electrode wiring 410 are formed from the same layer as the heat generating resistance element 405, and therefore, the substrate 401 can be manufactured without increasing the number of process steps. Further, as described above, this does not influence the arrangement of the driving elements and the selecting circuits.

By the above described process, a sheet resistance of about 350 Ω/□ is formed for the resistance value of the heat generating resistance element layer, and a sheet resistance of about 80 mΩ/□ is formed for the resistance value of the electrode wiring layer. The sheet resistance means the resistance which occurs in the square pattern of a thin film having a uniform thickness when a current is passed from one side to the other side parallel with the one side.

When the heat generating resistance elements 405 are arranged with a density of 600 dpi (Dots Per Inch), the pitch between centers of the heat generating resistance elements 405 is 25.4÷600=0.0423 mm (42.3 μm), since one inch is 25.4 mm. When 16 heat generating resistance elements 405 are connected to one electrode wiring, the required width is 0.0423 mm×16=0.6773 mm (677 μm). 677 μm is the length of one block which is time-sharing driven, and the length is equal to the difference in the length of the adjacent electrode wirings. The resistance of the wiring sheet in the electrode wiring layer is 80 mΩ/□ as described above. Providing that the width of the electrode wiring is, for example, 6 μm, the resistance value which one electrode wiring has in the length of one block is 677 μm÷6 μm×80 m Ω/□≅10 Ω.

In FIG. 4A, the electrode wiring 410B is divided into six blocks (block 1 to block 6) connected to the heat generating resistance elements 405, and the portion in the vicinity of the electrode pad 402 is set as a block 0 having the length equal to one block.

Seeing the circuit diagram of FIG. 4B at this time, in the section of the electrode wiring A 410A, the wiring resistor 412 and the adjustment resistor 411 are connected in each block. The electrode wiring A 410A connected to each block has the same width as 6 μm. The resistance value of the wiring resistor 412 is proportional to the length to each block from the electrode pad 402. When the difference in the resistance value according to the length of one block is set as 10 Ω as described above, the wiring resistor 412 has 10 Ω in block 1, 20 Ω in block 2 and 60 Ω in block 6.

At this time, the sum of the resistance values of the adjustment resistor 411 and the wiring resistor 412 is adjusted in each block so as to be equal to the resistance value of the wiring resistor 412 of the block 6. The adjustment resistance element 411 has the largest resistance value and 50 Ω in the block 1, 40 Ω in the block 2, and 0 Ω in the block 6. Specifically, if the resistance value of the adjustment resistor 411 is made the minimum, the adjustment resistor is not needed as in FIG. 4B.

By adjusting the resistance value of the adjustment resistor 411 like this, the sum of the resistance values of the adjustment resistance element 411 and the wiring resistor 412 is equal and 60 Ω in each of the blocks 1 to 6, and the heat generating resistance member 405 of any block can be caused to generate proper thermal energy.

The common wiring just before the electrode wiring connected to the electrode pad 402 branches in FIG. 4A can be regarded as having the same resistance value to the individual electrode wirings, and therefore, the resistance value of the common wiring is omitted in calculation of the resistance values.

When the adjustment resistance element 411 is to be formed by the heat generating resistance element layer, the following problems occur.

The width of the first portion 410B-1 of the electrode wiring 410 and the width of the second portion of the electrode wiring 410 are set to be, for example, 6 μm. Meanwhile, the width of the heat generating resistance element 405 is determined in advance from the discharge amount of an ink, and generally is 10 μm or more, and is set as, for example, 12

μm. In this case, if the resistance used for the heat generating resistance element layer is directly used for the resistance of the first portion 410B-1 of the electrode wiring 410, the same current flows into the electrode wiring 410B-1 which has about a half the width of the heat generating resistance element 405. Thereby, the current density is doubled, and energy per unit area is quadrupled. The electrode wiring 410 is not cooled by contacting the ink, and therefore, it breaks earlier than the heat generating resistance element 405 to reduce reliability.

Here, the case will be considered, in which the adjustment resistance element 411 using the heat generating resistance layer is formed in the first portion 410B-1 of the electrode wiring 410. When the width of the first portion 410B-1 of the electrode wiring 410 is above described 6 μm, the length of the adjustment resistance element is 6 μm×10 Ω÷350 Ω/□≅0.2 μm. Such an adjustment resistance element 411 is difficult to form by wet etching.

Regarding the above described problem, it is assumed that by increasing the area in the vicinity of the electrode pad 402, the adjustment resistance element 411 with a large width can be accurately formed in the vicinity of the electrode pad 402. In this case, a half or more of the resistance value of the total of those of the adjustment resistance element 411 and the wiring resistor 412 is concentrated on the electrode pad 402.

In this case, the resistance value in the vicinity of the electrode pad 402 (block 0) is 210 Ω (=10 Ω+20 Ω+30 Ω+40 Ω+50 Ω+60 Ω) with consideration given to the resistance value of the adjustment resistance element. Meanwhile, six electrode wirings branch from one electrode pad, and the entire resistance value of the electrode wirings is 360 Ω(=60 Ω×6) which is obtained by multiplying the resistance value of the longest electrode wiring by the number of electrode wirings if the resistance of the adjustment resistance element is included. Accordingly, the resistance of the ratio of 210 Ω/360 Ω≅58% is concentrated on the electrode pad 402 portion. In addition, the electrode wiring is not cooled by contacting the ink as described above. Therefore, the portion in the vicinity of the electrode pad 402 of the substrate is at a very high temperature, and heat distribution of the substrate becomes unbalanced.

Further, change in viscosity of the ink due to temperature change is also a serious problem. When the temperature of the substrate 401 abnormally rises, the viscosity of the ink reduces, and even if the same thermal energy is applied to the ink, the amount of discharged ink is increased. Generally, control is performed across the entire substrate to suppress energy by decreasing the time in which the voltage is applied to the heat generating resistance element 405, and to correct the discharge amount to a proper discharge amount. However, when only a part is at a high temperature like the part in the vicinity of the electrode pad 402, the discharge amount cannot be made proper by only the control of the entire substrate. As a result, the discharge amount varies due to temperature distribution and unevenness of the density occurs to degrade the quality.

When the adjustment resistance element 411 is disposed in the vicinity of the electrode pad 402 like this, the problems of reduction in reliability and degradation of quality are caused. In the present embodiment, the adjustment resistance element 411 is provided in the second portion of the electrode wiring 410. It is assumed that the density of the heat generating resistance element 405 is 600 dpi, and 16 heat generating resistance elements 405 are included in one block. In this case, the width of one block is 25.4÷600×16=0.677 mm (677 μm). Accordingly, with the space between the wirings taken into consideration, the width of about 600 μm can be ensured for the adjustment resistance element 411. This is the width at least 16 times larger than that of the heat generating resistance element 405, and the density of the current which flows is lower than 1/16 of that of the heat generating resistance element 405. The energy per area significantly decreases, and therefore, reliability higher than the heat generating resistance member 405 can be ensured after electric current has flowed in the heat generating resistance element 405 16 times as much as in the heat generating resistance element 405.

Further, the sheet resistance in the heat generating resistance element layer is 350 Ω/□ as described above, and if the width of about 600 μm is ensured for the adjustment resistance element 411, the length of the second portion 410B-2 of the electrode wiring 410 with a width of 600 μm is 600 μm×10 Ω÷350 Ω/□≅20 μm. If the length of 20 μm can be ensured, the adjustment resistance element 411 can be stably formed by wet etching. The resistance value of the adjustment resistance element 411 has to be changed for each block, and if the adjustment resistance element 411 has a length of about 20 μm, the resistance can be adjusted by changing the length of the adjustment resistance element 411. Therefore, influence on the length of the substrate is suppressed, and increase in the size of the substrate can be prevented.

Further, the adjustment resistance elements 411 are disposed by being dispersed in the substrate, and therefore, generated heat is also dispersed. For example, by using the above described calculation result, the sum of the resistance values of the wirings connected to the heat generating resistance elements of the block 0 is 60 Ω (=10 Ω×6). Since the resistance of all the electrode wirings is 360 Ω, about 17% of the entire resistance is concentrated on the part in the vicinity of the electrode pad, and when compared with the aforementioned 58%, the ratio to the entire resistance is significantly decreased.

Further, the resistance value of the adjustment resistance element 411 of the block 1 where the resistance value becomes the highest is 60 Ω (resistance value of the wirings connected to the heat generating resistance elements of the block 1)−10 Ω (resistance value of the wiring resistor in the section of the block 0)=50 Ω. Further, the total sum of the resistance values in the block 1 of the wirings connected to the heat generating resistance elements 405 of the block 2 to block 6 is 5 (number of wirings after the block 1)×10 Ω (resistance value of the wiring resistor in the section of the block 1)=50 Ω.

Accordingly, the resistance value of the block 1 is 100 Ω (=50 Ω+50 Ω), the resistance of all the electrode wirings 410 is 360 Ω, and therefore, the resistance value of the block 1 is only about 28% of the entire resistance value. Thereby, distribution of the resistance becomes uniform, and with this, uniform heat distribution is obtained. According to this, the adjustment resistance element 411 is widely disposed on the substrate and prevents the temperature from locally rising, and therefore, occurrence of the density unevenness is suppressed. Further, the time for intermitting printing is reduced, and therefore, printing speed can be maintained.

As described above, according to the present embodiment, the temperature distribution becomes uniform by providing the adjustment resistance element 411 on the substrate, and reduction in printing quality due to unevenness of ink density and reduction in printing speed due to rise in temperature can be prevented. Further, branched electrode wirings can be disposed with the minimum width, and therefore, increase in size of the substrate can be prevented.

The present embodiment shows an example in which the electrode wiring 410A and the electrode wiring 410B are respectively provided with the adjustment resistance elements 411, but the present invention is not limited to this example. As another example, the resistance values of both the electrode wiring 410A and the electrode wiring 410B may be adjusted by using the adjustment resistance element 411 for only any one of the electrode wirings.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application 2008-160676, filed Jun. 19, 2008 which is hereby incorporated by reference herein in its entirety.

What is claimed is:

1. A substrate for an ink jet head provided with a plurality of energy generating members which generate energy used for discharging an ink, wherein the plurality of energy generating members are provided in a row in a longitudinal direction of the substrate, the substrate has an electrode pad which is arranged near a side of the substrate extending in an intersecting direction intersecting with respect to the longitudinal direction, and is for electrically connecting to an outside of the substrate, a plurality of electrode wirings for electrically connecting the plurality of energy generating members and the electrode pad, and a plurality of resistance elements which are respectively provided at the plurality of electrode wirings, each of the plurality of electrode wirings includes a first portion extending in the longitudinal direction from a side of the electrode pad of each of the electrode wirings, and a second portion which extends in the intersecting direction from a side of the first portion opposite from the side of the electrode pad toward the energy generating members and is provided with the resistance elements, and resistance values of the plurality of resistance elements differ from one another according to resistance values of the electrode wirings provided with the respective resistance elements.

2. The substrate for an ink jet head according to claim 1, wherein each of the resistance elements is formed from another portion of a resistance layer including a portion forming the energy generating members.

3. The substrate for an ink jet head according to claim 1, wherein a plurality of driving elements for driving the plurality of energy generating members respectively are provided between the electrode pad and the plurality of energy generating members.

4. The substrate for an ink jet head according to claim 1, wherein a plurality of the first portions are equal to one another in width with respect to the intersecting direction, and are not provided with the resistance elements.

5. The substrate for an ink jet head according to claim 1, wherein among the plurality of energy generating members, an energy generating member at a shorter distance from the electrode pad has a larger resistance value of the resistance element which is provided correspondingly.

6. An ink jet head, having:

the substrate for an ink jet head according to claim 1, and a member which is provided in contact with the substrate, and is provided with discharge ports for ink provided to correspond to the energy generating members.

* * * * *